US007350509B2

(12) United States Patent
Barz et al.

(10) Patent No.: US 7,350,509 B2
(45) Date of Patent: Apr. 1, 2008

(54) DELIVERY UNIT

(75) Inventors: Torsten Barz, Maintal-Wachenbuchen (DE); Joachim Hoffmann, Lebach (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/591,189

(22) PCT Filed: Jan. 27, 2005

(86) PCT No.: PCT/EP2005/050349

§ 371 (c)(1),
(2), (4) Date: May 25, 2007

(87) PCT Pub. No.: WO2005/085623

PCT Pub. Date: Sep. 15, 2005

(65) Prior Publication Data

US 2007/0215537 A1 Sep. 20, 2007

(30) Foreign Application Priority Data

Mar. 3, 2004 (DE) ..... 10 2004 010 358

(51) Int. Cl.
*F02M 37/04* (2006.01)
*F02M 37/10* (2006.01)

(52) U.S. Cl. ..... 123/509; 210/416.4

(58) Field of Classification Search ..... 123/509, 123/495, 497; 137/576, 574; 210/416.4, 210/461

See application file for complete search history.

(56) References Cited

U.S. PATENT DOCUMENTS

| | | | | |
|---|---|---|---|---|
| 5,452,701 | A * | 9/1995 | Tuckey | 123/509 |
| 5,699,773 | A | 12/1997 | Kleppner et al. | |
| 6,155,793 | A | 12/2000 | Tuckey et al. | |
| 6,260,543 | B1 | 7/2001 | Chih | |
| 6,464,872 | B1 | 10/2002 | Honda | |
| 6,502,558 | B1 | 1/2003 | Brunel | |
| 6,613,227 | B2 * | 9/2003 | Rickle | 210/243 |
| 6,739,844 | B1 * | 5/2004 | Yu et al. | 417/366 |
| 2001/0030148 | A1 * | 10/2001 | Knight | 210/130 |
| 2003/0132156 | A1 * | 7/2003 | Rickle | 210/416.4 |
| 2003/0206814 | A1 * | 11/2003 | Djordjevic | 417/313 |

FOREIGN PATENT DOCUMENTS

| | | |
|---|---|---|
| DE | WO 96/41727 | 12/1996 |
| DE | 198 34 653 C1 | 12/1999 |
| DE | 199 15 255 A1 | 10/2000 |
| GB | 2 340 096 A | 2/2000 |

* cited by examiner

*Primary Examiner*—Mahmoud Gimie
(74) *Attorney, Agent, or Firm*—Cohen Pontani Lieberman & Pavane LLP

(57) ABSTRACT

The invention relates to a delivery unit (2) comprising a swirl pot (5), a fuel pump (6) placed therein, and a filter, which is placed on the bottom (7) of the swirl pot (5) and which is radially flowed against. This filter is formed by shaped elements axially protruding from the bottom (7) of the swirl pot (5) whereby forming an axially extending gap (11, 11*a*, 11*b*) between every two adjacent shaped elements (10), and the filter surrounds an inlet opening (13) located in the bottom (7) of the swirl pot (5). At least one flow-through area (12) is situated perpendicular to the gaps (11, 11*a*, 11*b*) and perpendicular to the flow-through direction, this at least one area (12) connecting at least two adjacent gaps (11, 11*a*, 11*b*).

14 Claims, 3 Drawing Sheets

DELIVERY UNIT

BACKGROUND OF THE INVENTION

The subject of the invention is a delivery unit, with a baffle, with a fuel pump arranged therein and with a radial-onflow filter which is arranged on the bottom of the baffle and which is formed by shaped elements projecting axially from the bottom of the baffle, so that an axially running gap is formed in each case between two adjacent shaped elements in each case, and which surrounds an inlet port arranged in the bottom of the baffle. The delivery unit serves for delivering fuel out of the fuel tank to an internal combustion engine of a motor vehicle.

It is known to use delivery units of this type in fuel tanks. Impurities contained in the fuel may enter the fuel pump and damage this. In order to protect the fuel pump against these impurities, the fuel sucked in by the fuel pump is filtered. For this purpose, the fuel pump is preceded by a coarse filter, so that the particles, which could lead to damage to the fuel pump, are kept away from the suction-intake region of the fuel pump.

In addition to various forms of filter construction which are additionally mounted as separate parts on the baffle, it is known to arrange a filter crown on the bottom of the baffle. The filter crown is formed by shaped portions provided on the bottom of the baffle. These shaped portions are arranged at a distance from one another and serve at the same time as a standing surface for the baffle. When the baffle stands on the bottom of the fuel tank, the shaped portions form a filter of the radial-onflow type with axially running gaps. The inlet port, through which the prefiltered fuel enters the baffle, is located within this crown of shaped portions. The width of the axially running gaps is in this case a measure of the degree of filtering of the gap filter. The disadvantage of this device is that, due to the small width of the axially running gaps, the throughflow cross section for the fuel flowing to the inlet port is reduced. In order to ensure a sufficient supply of fuel to the suction-intake port, a specific throughflow cross section should not be undershot. Consequently, the gap width selected cannot be as small as desired, and therefore the degree of filtering of the gap filter is limited.

The object on which the present invention is based is, therefore, to provide a delivery unit with a filter which both provides sufficient fuel for the suction-intake port and possesses a high degree of filtering.

BRIEF DESCRIPTION OF THE INVENTION

The object is achieved, according to the invention, in that at least one region for throughflow is arranged perpendicularly to the gaps and perpendicularly to the throughflow direction, and in that the at least one region connects at least two adjacent gaps.

By further regions for throughflow being arranged, further areas for the filter onflow are afforded. The enlargement of the onflow area makes it possible to have either a larger throughflow cross section of the filter or, if the throughflow cross section remains the same, a reduction in size of the gaps and of the regions arranged perpendicularly thereto. The reduction in size of the gaps and regions has the advantage that smaller particles than hitherto are retained, thus leading to an increase in the degree of filtering.

The regions for throughflow can be produced at low outlay and therefore cost-effectively when at least one, preferably three, standing elements with a greater axial length than the shaped elements are arranged on the bottom of the baffle, so that the baffle sits with the standing elements on the tank bottom. The difference in the axial length of the standing elements and of the shaped elements determines the distance of the shaped elements from the tank bottom, thus resulting in the regions for throughflow.

In a further advantageous refinement, additional standing elements for providing the regions for throughflow can be avoided if the shaped elements are produced with different axial lengths. In this case, it is sufficient to form at least one, preferably three, shaped elements with a greater axial length. In the case of a large number of shaped elements, 5% to 50% of the shaped elements may also have a greater axial length. These shaped elements sit on the tank bottom, whereas the other shaped elements are arranged at a distance from the tank bottom, so that the regions for throughflow are formed between the end faces of the axially shorter shaped elements and the tank bottom.

An increase in the degree of filtering can be achieved in a simple way by the shaped elements being arranged with respect to the throughflow direction in a plurality of rows lying one behind the other. Arranging the shaped elements in successive rows so as to be offset in the throughflow direction causes a labyrinth formation, with the result that the degree of filtering can likewise be improved.

A selective filter is obtained by shaped elements of equal axial length being arranged in a row. In this case, it is advantageous if the shaped elements of the radially outer row possess a smaller axial length than the shaped elements of the radially inner rows.

In a further refinement, the degree of filtering can be influenced in that the gaps located between the shaped elements are designed differently in their length and width.

A simple configuration of the shaped elements allows arrangement in segments on the bottom of the baffle. Since the configuration of the shaped elements determines the degree of filtering, there is a further advantage in that the delivery unit can be adapted to the corresponding conditions of use solely as a result of a deliberate selection of suitable segments in terms of the degree of filtering. Particularly in delivery units with baffles produced by the injection molding method, this refinement makes it possible to exchange the segments, while the baffle can be preserved, unchanged. The exchange of the segments can be implemented, for example, by means of corresponding inserts in the injection molding dies.

In a development of the invention, adaptation to different conditions of use is facilitated if the segments are connected releasably to the baffle, preferably by means of latching or plug connections. Moreover, a releasable connection of the segments to the baffle makes it possible to exchange the segments, particularly in the event of the wear or clogging of the filter.

A weakening of the degree of filtering is avoided if the distance between two adjacent segments is no greater than the distance of the shaped elements from one another.

According to the arrangement of the shaped elements in a plurality of rows with respect to the throughflow direction, on a segment the shaped elements may be arranged in one or more rows in each case on one segment or on a plurality of segments, the segments likewise being arranged in a plurality of rows in the throughflow direction.

On account of the improved degree of filtering, the filter no longer has to be arranged solely at the radially outer end of the baffle bottom. Thus, the invention makes it possible for the shaped elements to be arranged directly in the region of the inlet port.

In addition to a circular design, the filter may also be of star-shaped design or be designed as a polygon.

BRIEF DESCRIPTION OF THE DRAWINGS

The invention is described in more detail with reference to a plurality of exemplary embodiments. In the drawing.

DETAILED DESCRIPTION OF THE INVENTION

Figure 1:
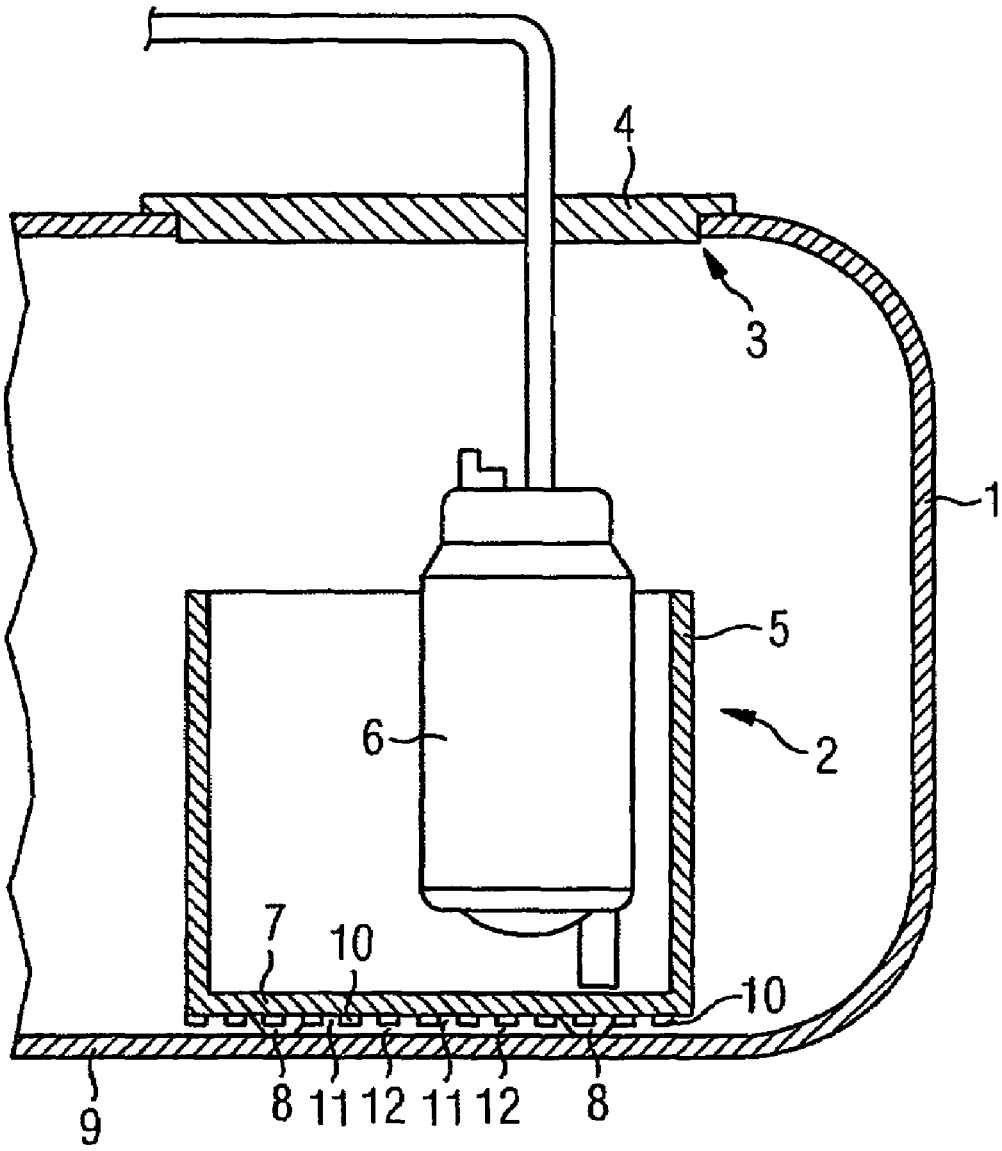
FIG. 1 shows a fuel tank with a delivery unit.

The fuel tank 1 illustrated in FIG. 1 contains a delivery unit 2. The delivery unit 2 is inserted into a port 3 of the fuel tank 1, a flange 4 closing the port 3 in the fuel tank 1.

The delivery unit 2 comprises a baffle 5 for receiving fuel and a fuel pump 6, arranged therein, which delivers fuel to an internal combustion engine, not illustrated, of the motor vehicle. Furthermore, it is conceivable also to use the baffle 5 in a suction-intake unit in which the fuel pump is arranged outside the baffle.

Standing elements 8, with which the baffle 5 sits on the tank bottom 9, are shaped on the bottom 7 of the baffle 5. Shaped elements 10 likewise formed on the bottom 7 of the baffle 5 are arranged at distances from one another such that two adjacent shaped elements 10 in each case enclose a gap 11. A smaller axial extent of the shaped elements 10 with respect to the standing elements 8 causes the formation of regions 12 between the shaped elements 10 and the tank bottom 9, so that fuel can flow through the gaps 11 in the regions 12. The selected gaps 11 and regions 12 are in this case so small that particles contained in the fuel are retained by the shaped elements 10.

Figure 2:
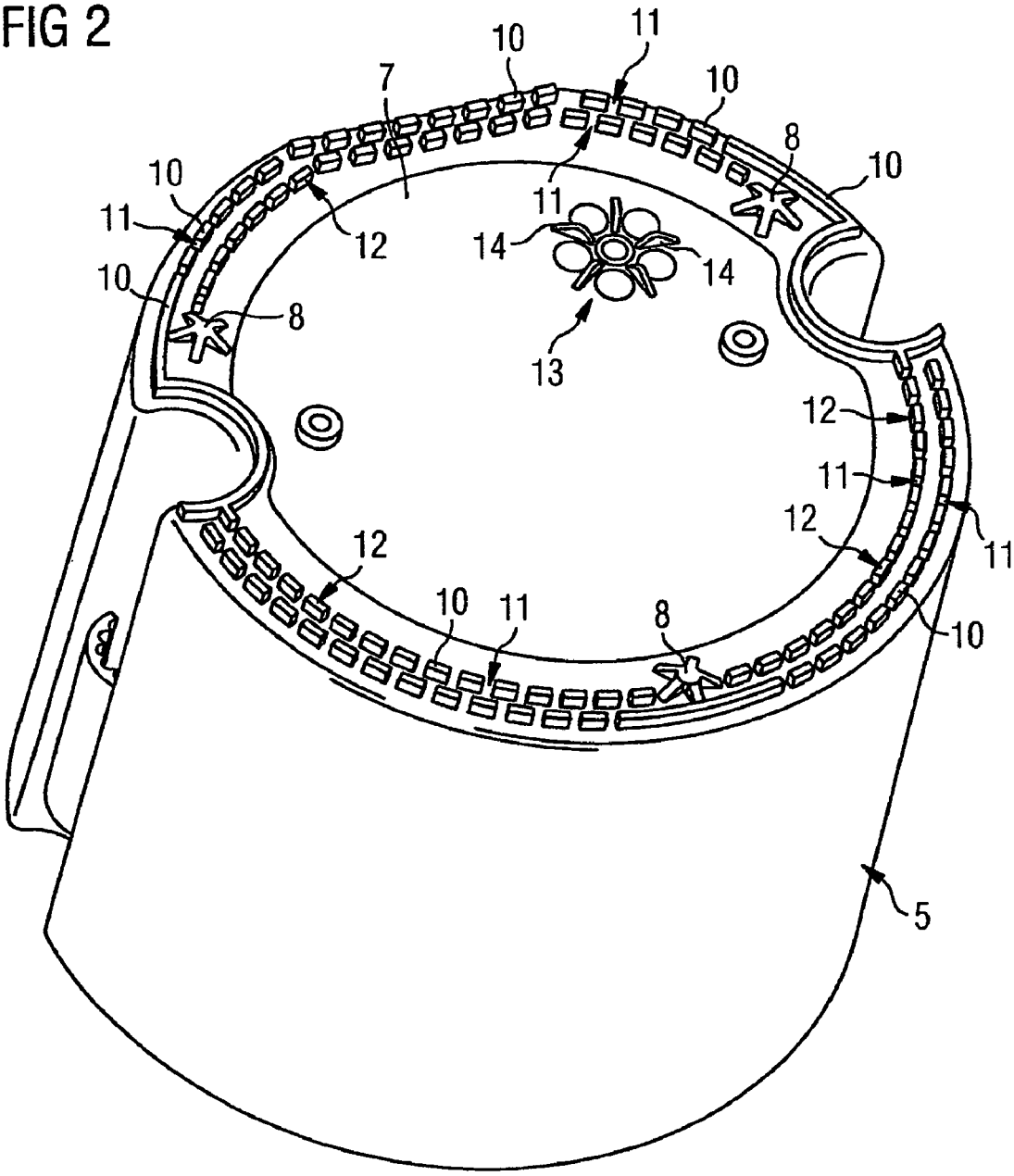
FIG. 2 shows a perspective illustration of the baffle of the delivery unit according to FIG. 1.

FIG. 2 shows a top view of the bottom 7 of the baffle 5 from FIG. 1. The bottom 7 possesses an inlet port 13 through which fuel passes out of the fuel tank 1 into the baffle 5. The inlet port 13 is provided with spacers 14 which possess the same axial length as the standing elements 8. The inlet port 13 is surrounded by shaped elements 10 which are shaped in one piece on the bottom 7 of the baffle 5. Owing to the distance of the shaped elements 10 from one another, axially running gaps 11 are formed between these. Moreover, the smaller axial extent of the shaped elements 10 with respect to the standing elements 8 causes the formation of regions 12 between the end faces 16 of the shaped elements 10 and the tank bottom 9, each region 12 in each case connecting two of the axially running gaps 11. The fuel located in the tank 1 can thus pass through the gaps 11 and the regions 12 to the inlet port 13. Particles contained in the fuel are kept away from the inlet port 13 by the shaped elements 10. Owing to a corresponding configuration of the axial extent of the shaped elements 10 and of the standing elements 8, the axial height of the regions 12 and consequently the degree of filtering can be set in a deliberate way. To increase the degree of filtering, the shaped elements 8 are arranged one behind the other in two rows in the throughflow direction, a gap 11 in the radially outer row being followed by a shaped element 8 in the radially inner row, and vice versa.

Figure 3:
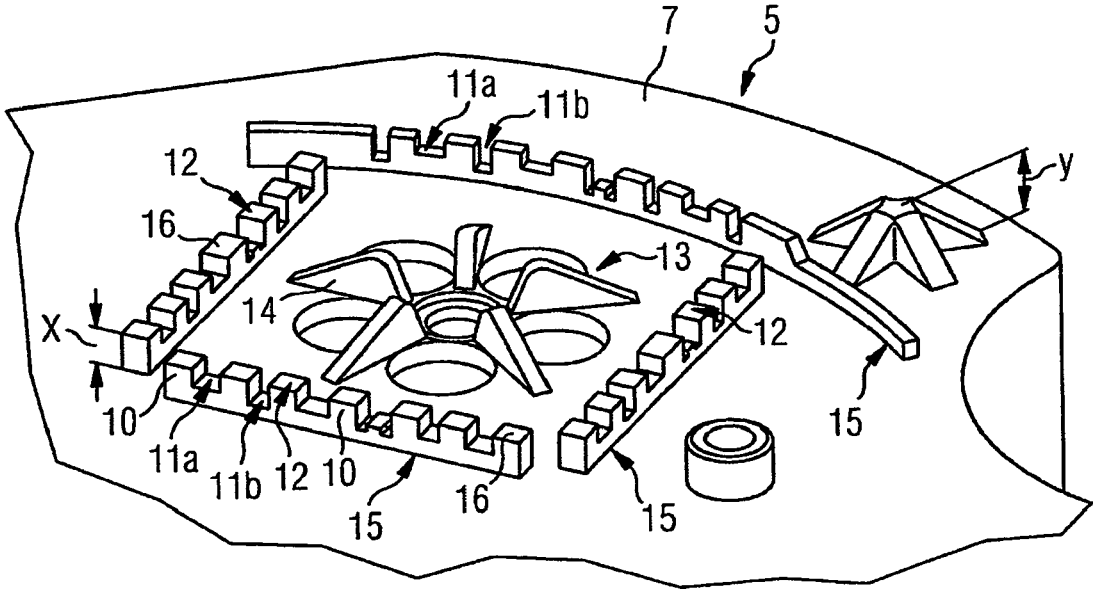
FIG. 3 shows a second embodiment of a baffle in an enlarged illustration.

FIG. 3 shows an enlarged illustration of the inlet port 13 in the bottom 7 of the baffle 5. The shaped elements 10 are arranged in four segments 15 around the inlet port 13. The segments 15 may be connected to the baffle 5 both in one piece and releasably by means of a latching or plug connection. So as not to lower the filter action, the distances 16 between the segments 15 correspond essentially to the widths of the gaps 11.

In contrast to FIG. 2, the shaped elements 10 according to FIG. 3 are arranged asymmetrically. The gaps 11*a*, 11*b* formed between two shaped elements 10 vary in their length and width. The shaped elements 10 possess a smaller axial extent x than the standing elements 8 (y) which sit on the tank bottom, not illustrated. Owing to this difference in axial extent, regions 12 are formed between the tank bottom 9 and the end faces 16 of the shaped elements 10, fuel flowing through said regions and also through the gaps 11 to the inlet port 13.

The invention claimed is:

1. A delivery unit, with a baffle, with a fuel pump arranged therein and with a radial-onflow filter which is arranged on an underside of a bottom of the baffle and which is formed by shaped elements projecting axially from the underside of the bottom of the baffle, so that an axially running gap is formed in each case between two adjacent shaped elements, and which surrounds an inlet port arranged in the bottom of the baffle, characterized in that at least one region (12) for throughflow is arranged perpendicularly to the gaps (11, 11*a*, 11*b*) and perpendicularly to the throughflow direction, and in that the at least one region (12) connects at least two adjacent gaps (11, 11*a*, 11*b*) and wherein the at least one region (12) and gaps (11, 11*a*, 11*b*) define a fuel filter media.

2. The delivery unit as claimed in claim 1, characterized in that the regions (12) for throughflow are formed by at least one standing element (8) arranged on the underside of the bottom (7) of the baffle (5) and having a greater axial length than the shaped elements.

3. The delivery unit as claimed in claim 1, characterized in that the regions (12) for throughflow are formed by shaped elements with different axial lengths.

4. The delivery unit as claimed in claim 1, characterized in that the shaped elements are arranged in a plurality of rows lying one behind the other in the throughflow direction.

5. The delivery unit as claimed in claim 1, characterized in that the shaped elements are of equal axial length and are arranged in a row.

6. The delivery unit as claimed in claim 4, characterized in that shaped elements of a radially outer row possess a smaller axial length than shaped elements of a radially inner row.

7. The delivery unit as claimed in claim 1, characterized in that the axially running gaps (11, 11*a*, 11*b*) between the shaped elements possess different lengths and widths.

8. The delivery unit as claimed in claim 1, characterized in that the shaped elements are arranged in segments (15) on the underside of the bottom (7) of the baffle (5).

9. The delivery unit as claimed in claim 8, characterized in that the segments (15) are arranged releasably on the underside of the bottom (7) of the baffle (5).

10. The delivery unit as claimed in claim 8, characterized in that the segments (15) are shaped in one piece on the baffle (5).

11. The delivery unit as claimed in claim 8, characterized in that the distance between two adjacent segments (15) is no greater than the distance of the shaped elements from one another.

12. The delivery unit as claimed in claim 8, characterized in that the segments (15) are arranged in a plurality of rows in the throughflow direction.

13. The delivery unit as claimed in claim 2, characterized in that the shaped elements are arranged circularly.

14. The delivery unit as claimed in claim 2, characterized in that the shaped elements are arranged in the form of a polygon.

* * * * *